US012392575B2

(12) United States Patent
Obteshka et al.

(10) Patent No.: US 12,392,575 B2
(45) **Date of Patent: *Aug. 19, 2025**

(54) CROSSBOW WITH SPIRAL WOUND CAM SYSTEM

(71) Applicant: Ravin Crossbows, LLC, Superior, WI (US)

(72) Inventors: Nicholas Obteshka, Springfield, OR (US); Craig Yehle, Winona, MN (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/623,937

(22) Filed: Apr. 1, 2024

(65) Prior Publication Data

US 2024/0247906 A1 Jul. 25, 2024

Related U.S. Application Data

(63) Continuation of application No. 17/973,258, filed on Oct. 25, 2022, now Pat. No. 11,946,718.

(60) Provisional application No. 63/272,030, filed on Oct. 26, 2021.

(51) Int. Cl.
*F41B 5/12* (2006.01)
*F41B 5/10* (2006.01)

(52) U.S. Cl.
CPC ..... *F41B 5/123* (2013.01); *F41B 5/105* (2013.01)

(58) Field of Classification Search
CPC ..... F41B 5/123
See application file for complete search history.

(56) References Cited

U.S. PATENT DOCUMENTS

| | | | | |
|---|---|---|---|---|
| 9,377,267 | B1 | 6/2016 | Kempf | |
| 9,879,938 | B1 | 1/2018 | Isenhower et al. | |
| 10,077,965 | B2 | 9/2018 | Yehle | |
| 10,495,404 | B2 | 12/2019 | Shaffer et al. | |
| 10,767,956 | B2 | 9/2020 | Popov | |
| 11,946,718 | B2 * | 4/2024 | Obteshka | F41B 5/123 |
| 2019/0360774 | A1 | 11/2019 | Popov | |
| 2022/0205755 | A1 | 6/2022 | Yehle | |
| 2022/0307791 | A1 | 9/2022 | Trpkovski | |

* cited by examiner

*Primary Examiner* — John A Ricci
(74) *Attorney, Agent, or Firm* — Foley & Lardner LLP

(57) ABSTRACT

A crossbow includes a frame, first and second limbs, first and second cams, a drawstring, and first and second power cables. The frame includes a first side and a second side. The frame defines a projectile axis. The first limb is coupled to the first side and the second limb coupled to the second side. The first cam is coupled to the first side and configured to rotate about a first cam axis that is substantially parallel to the projectile axis. The second cam is coupled to the second side and configured to rotate about a second cam axis that is substantially parallel to the projectile axis. The drawstring is engaged with the first cam and the second cam. The first power cable is engaged with the first cam and the first limb. The second power cable engaged with the second cam and the second limb.

20 Claims, 19 Drawing Sheets

CROSSBOW WITH SPIRAL WOUND CAM SYSTEM

CROSS-REFERENCE TO RELATED APPLICATIONS

This application is a continuation of U.S. patent application Ser. No. 17/973,258, entitled CROSSBOW WITH SPIRAL WOUND CAM SYSTEM, filed on Oct. 25, 2022, which claims the benefit of and priority to U.S. Provisional Patent Application No. 63/272,030, entitled CROSSBOW WITH SPIRAL WOUND CAM SYSTEM, filed on Oct. 26, 2021, each of which are incorporated herein by reference in their entireties.

BACKGROUND

Crossbows utilize a drawstring that is drawn backward and released to fire a projectile. A common projectile is called a "bolt," which is a type of arrow that is often stiffer and shorter than those used in archery bows. In crossbows, flexible limbs may be loaded with force by the drawstring being drawn, and limbs are unloaded with force when the crossbow is fired that powers the movement of the drawstring toward the front of the crossbow.

The more aggressively the drawstring travels to the front of the crossbow, the faster a bolt can be fired from the crossbow. As such, the higher the force required to load the flexible limbs, the faster the flexible limbs become unloaded when the crossbow is fired. Similarly, the higher the force it takes to load the flexible limbs the higher the force—draw weight—required to draw the drawstring. Drawing aids and let-off cams are often used to aid the shooter in both drawing the drawstring and keeping the power drawstring drawn until it is released when fired.

As such, there is a need for a crossbow that fires a projectile at sufficient speeds, while also maintaining a compact form factor and allowing the shooter to more easily draw the drawstring when arming the crossbow.

SUMMARY

This application generally relates to a crossbow. In particular, this application relates to a crossbow having pulleys and cams to improve performance of the crossbow.

The disclosure is directed to a crossbow. The crossbow includes a frame, first and second flexible limbs, first and second cams, a drawstring, and first and second power cables. The frame includes a first frame side and a second frame side. The frame defines a projectile axis. The first flexible limb is coupled to the first frame side and the second flexible limb coupled to the second frame side. The first cam is coupled to the first frame side and configured to rotate about a first cam axis that is substantially parallel to the projectile axis. The second cam is coupled to the second frame side and configured to rotate about a second cam axis that is substantially parallel to the projectile axis. The drawstring is engaged with the first cam and the second cam. The first power cable is engaged with the first cam and the first flexible limb. The second power cable engaged with the second cam and the second flexible limb.

The disclosure is also directed to a crossbow that includes a frame, a flexible limb, a drawstring, a power cable, and a cam. The frame includes a frame side. The frame defines a projectile axis. The flexible limb is coupled to the first frame side. The drawstring is coupled to the flexible limb and configured to move within a first plane. The projectile axis extends within the first plane. The power cable is engaged with the flexible limb. The cam is coupled to the frame side. The cam is configured to rotate about a cam axis that extends within a second plane. The second plane is substantially parallel to the projectile plane. The cam includes a first portion configured to engage the drawstring and a second portion configured to engage the power cable.

The disclosure is also directed to a crossbow that includes a frame, a first flexible limb, a second flexible limb, a first cam, a second cam, a drawstring, a first power cable, and a second power cable. The frame defines a projectile axis. The first flexible limb and the second flexible limb are coupled with the frame. The first cam is coupled with the frame and configured to rotate about a first axis positioned vertically below the projectile axis. The first cam includes a first portion and a second portion. The second cam is coupled with the frame and configured to rotate about a second axis positioned vertically below the projectile axis. The second cam includes a first portion and a second portion. The drawstring is engaged with the first portion of the first cam and the first portion of the second cam. The first power cable is engaged with the first flexible limb and the second portion of the first cam. The second power cable is engaged with the second flexible limb and the second portion of the second cam.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
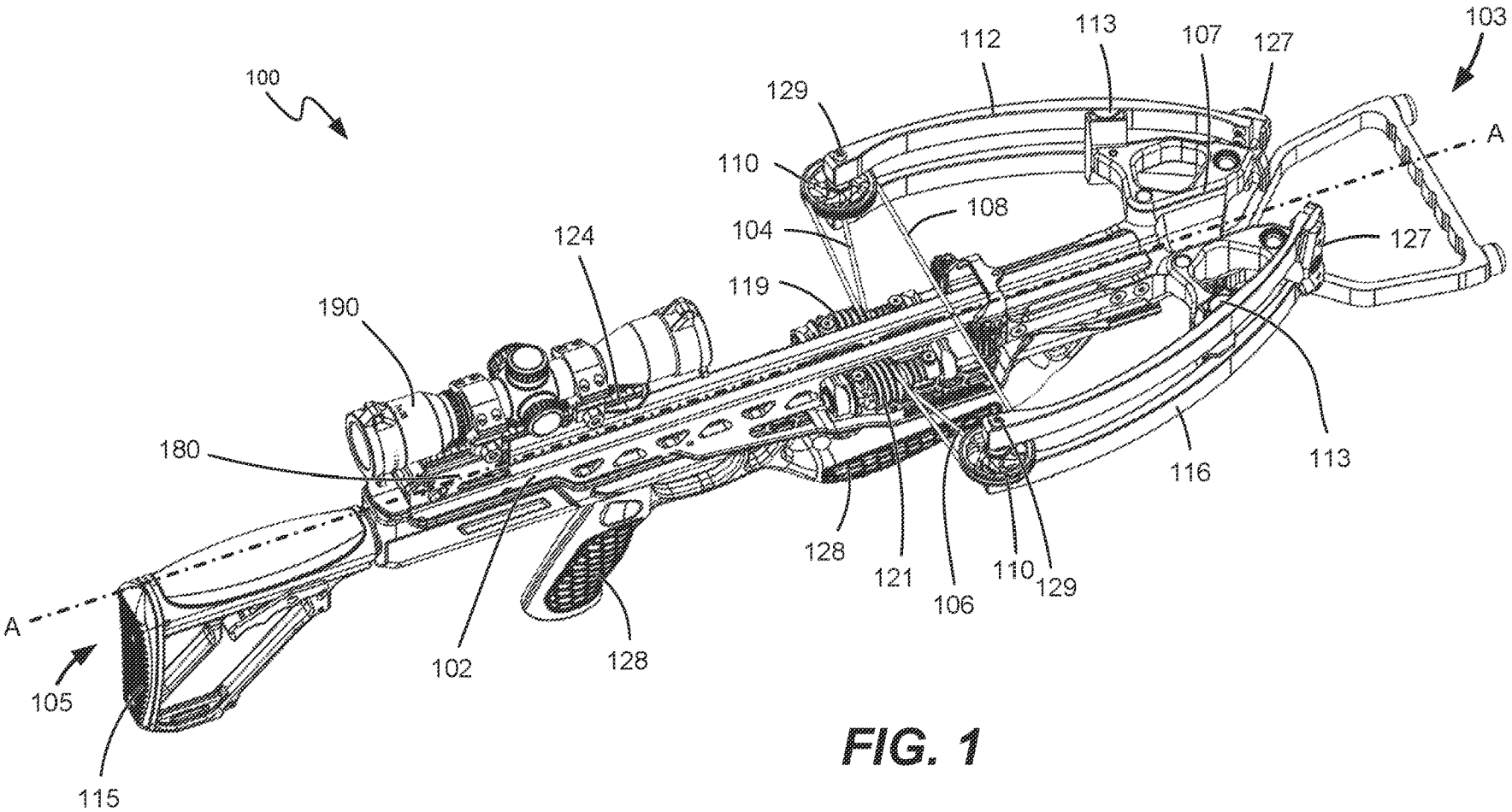
FIG. 1 is a rear perspective view of one embodiment of a crossbow according to the principles of the present disclosure, showing the crossbow in an undrawn position.
Figure 2:
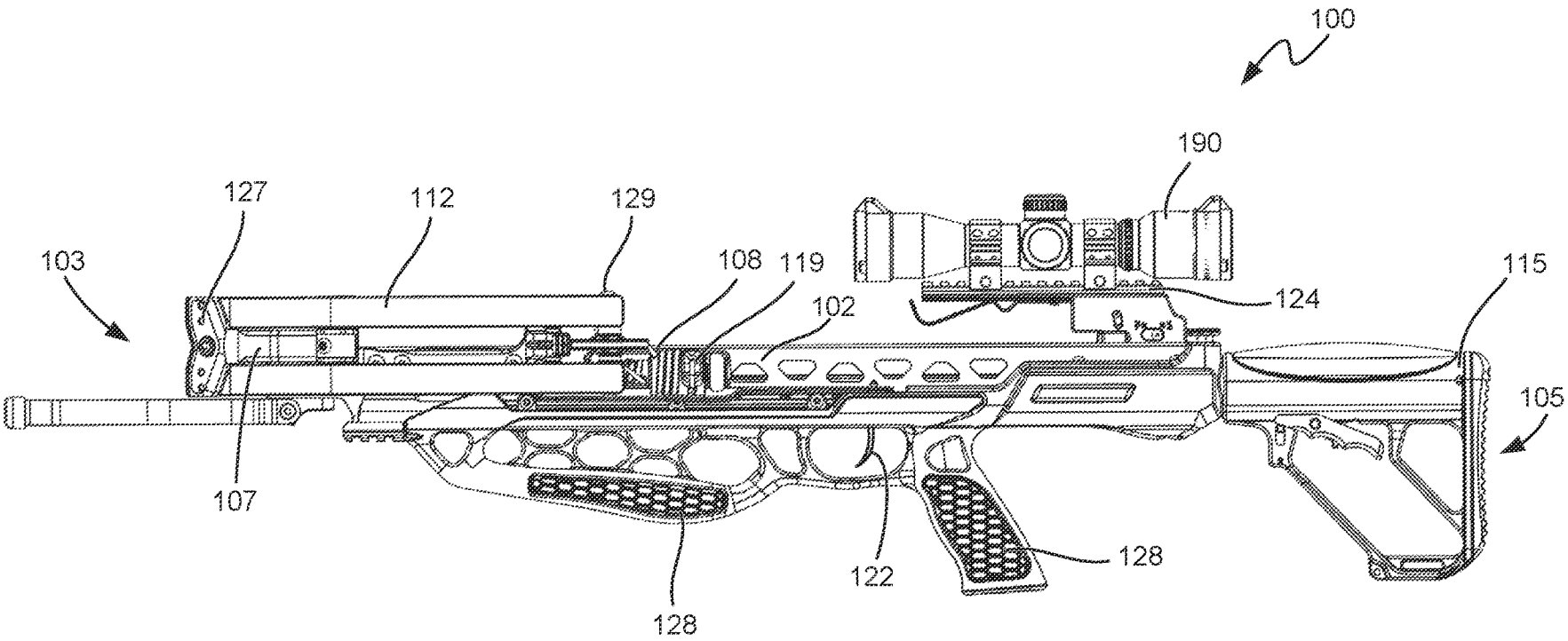
FIG. 2 is a side view of the crossbow of FIG. 1.
Figure 3:
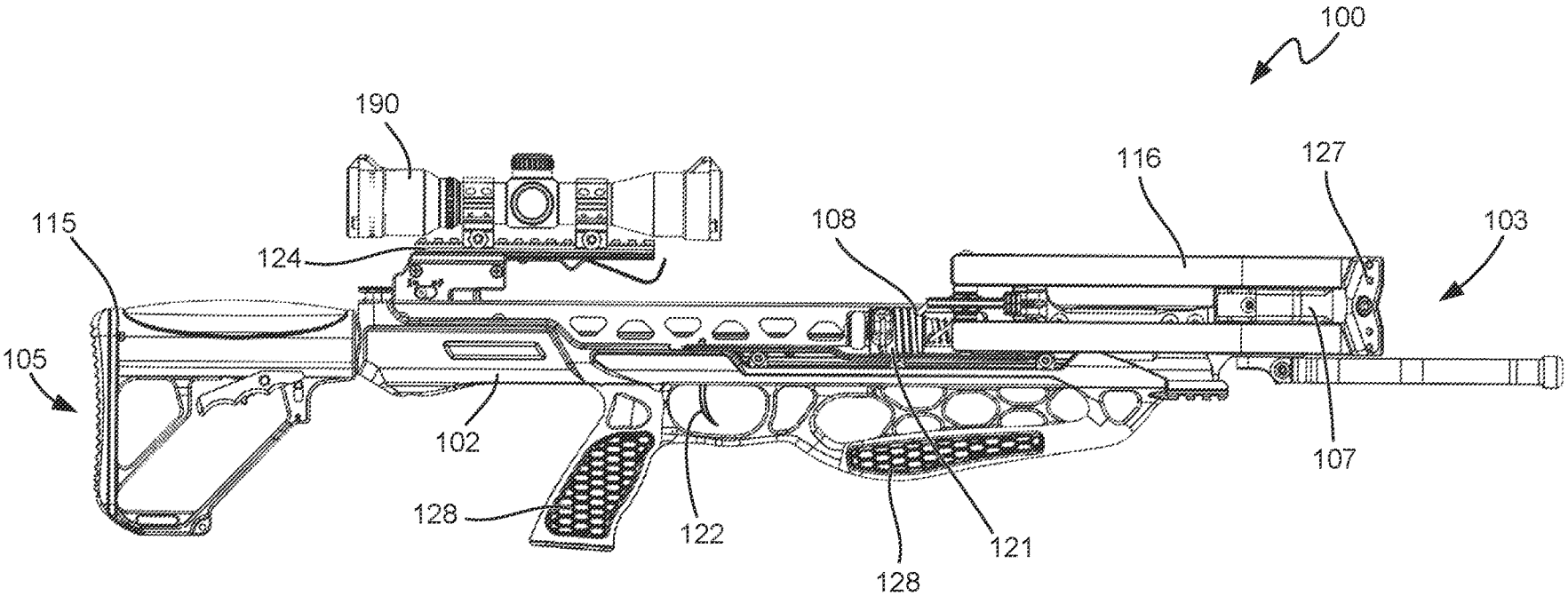
FIG. 3 is another side view of the crossbow of FIG. 1.
Figure 4:
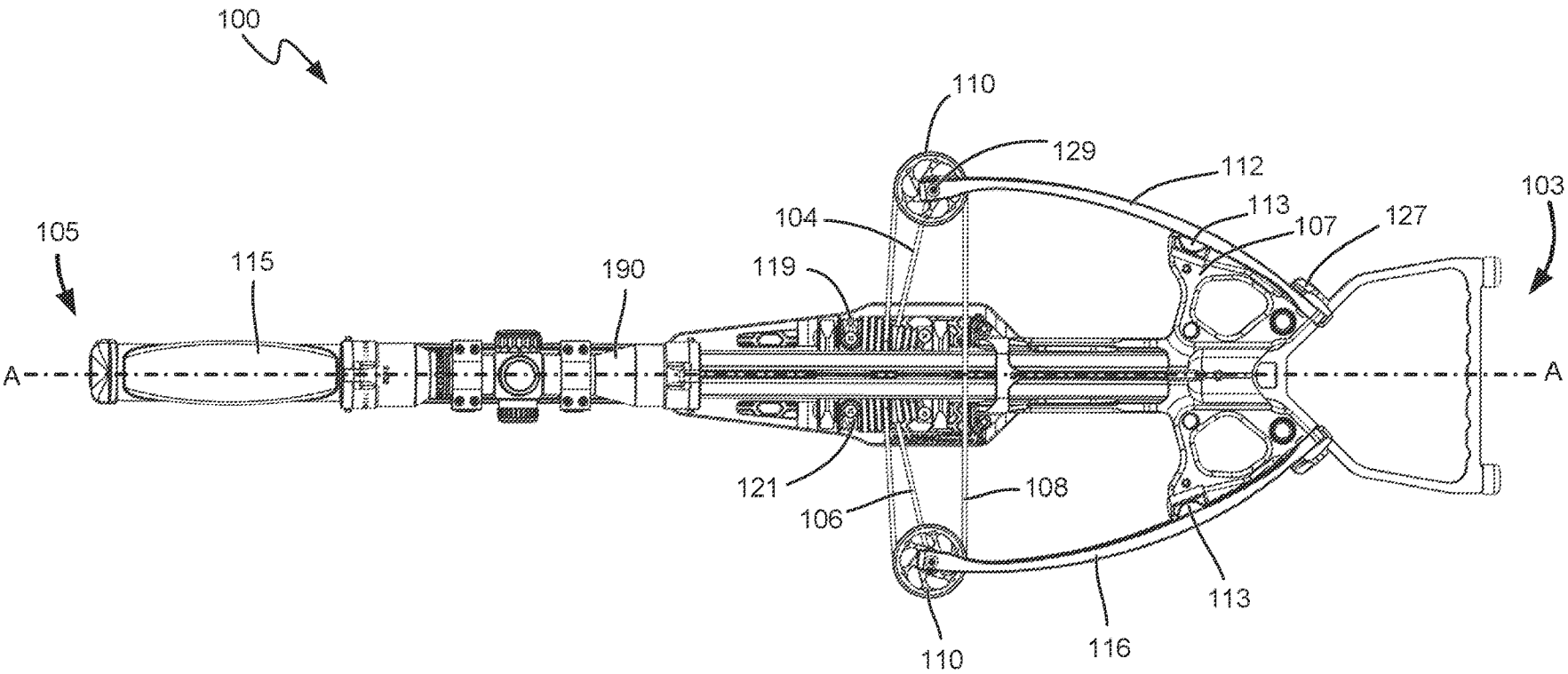
FIG. 4 is a top view of the crossbow of FIG. 1.
Figure 5:
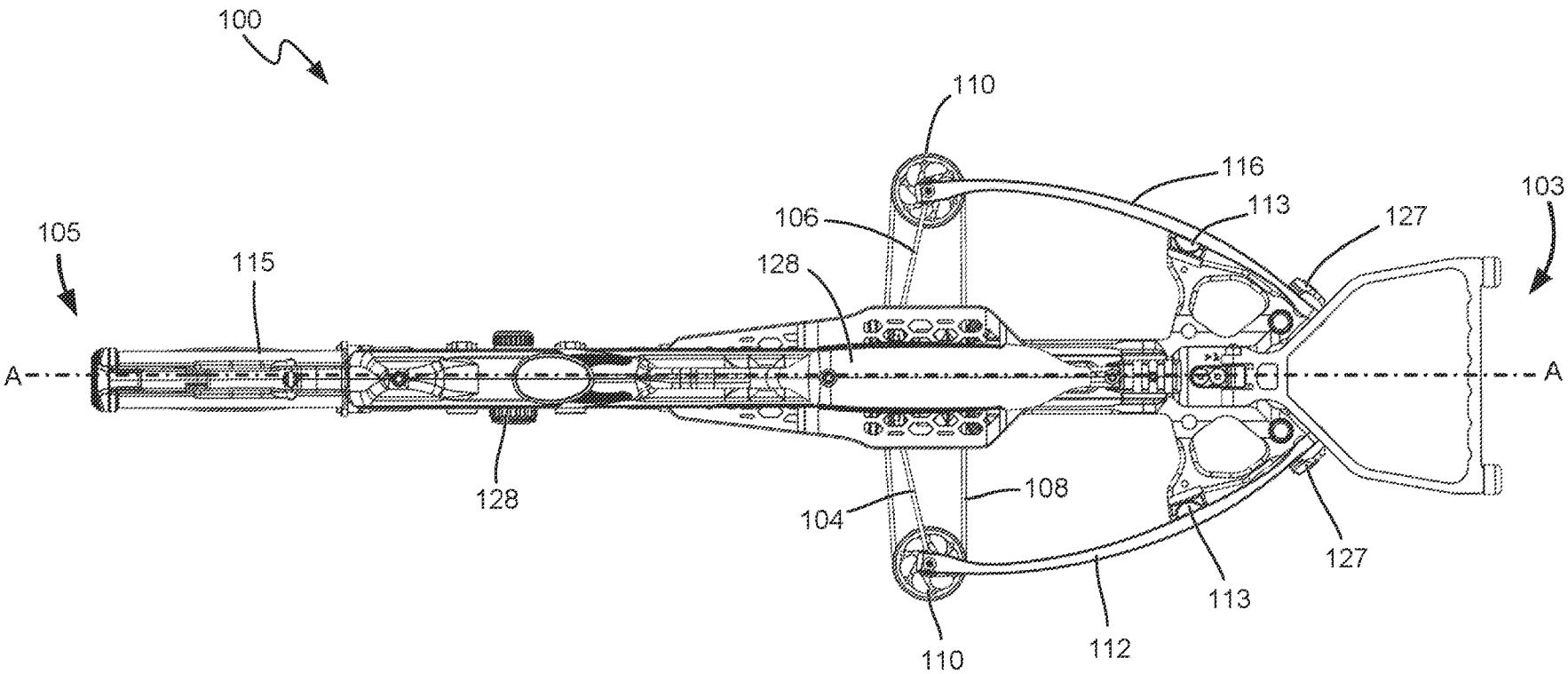
FIG. 5 is a bottom view of the crossbow of FIG. 1.
Figure 6:
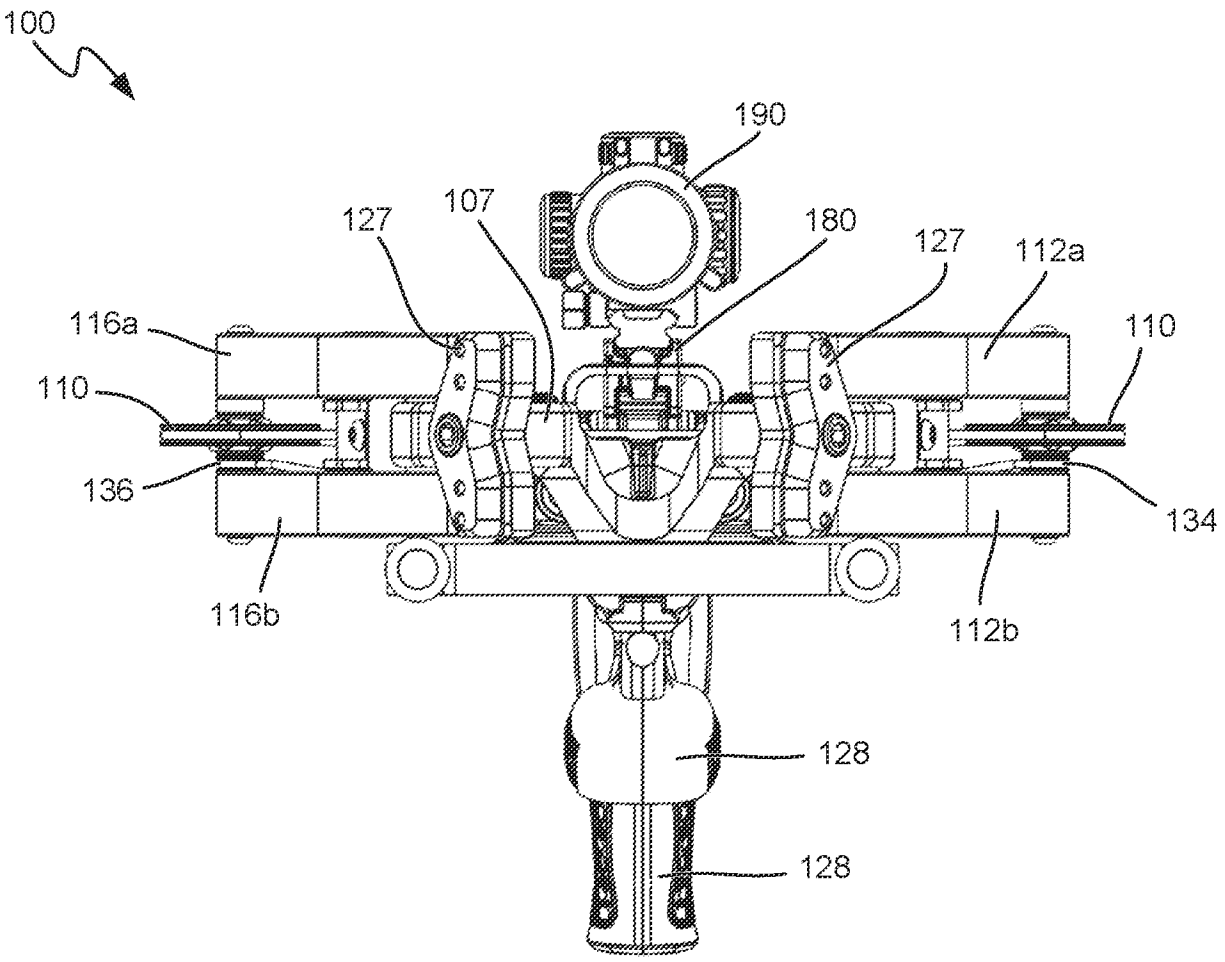
FIG. 6 is a front view of the crossbow of FIG. 1.
Figure 7:
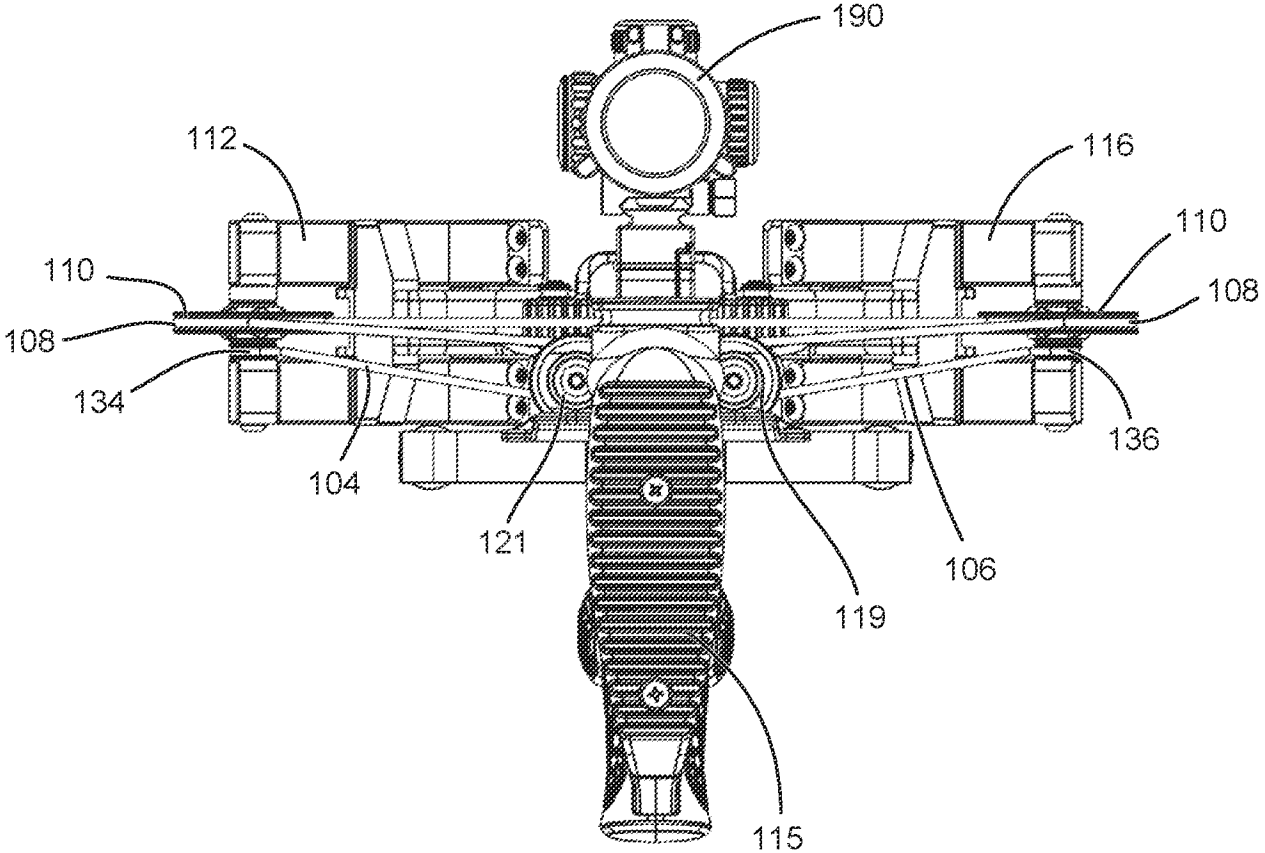
FIG. 7 is a rear view of the crossbow of FIG. 1.

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The crossbows disclosed herein can be used in a variety of different arrangements to improve efficiency, improve balance, improve safety, shoot different projectiles, and improve accuracy. The draw weight of the drawstring is the pulling force required to draw the drawstring to a rear of the crossbow. By introducing a mechanical advantage to the draw weight of the drawstring, power cables can load powerful flexible limbs with less pulling force. Because a powerful flexible limb can be loaded, the flexible limb can power the drawstring more aggressively (i.e., move faster) toward the front of the crossbow when firing, thus leading to firing a projectile at a faster speed.

FIGS. 1-12 show one embodiment of a crossbow 100 according to the principles of the present disclosure. Crossbow 100 can be configured in a variety of different ways without departing from the principles of this disclosure.

In the embodiment shown, crossbow 100 includes a frame 102 to which various components are attached. The frame 102 can be constructed of materials including carbon fiber composite, wood, aluminum, or other suitable materials. As shown, a stock 115 is attached to frame 102 at a rear end 105. In some examples, the stock 115 may be integrally formed with frame 102 as a singular unibody component without departing from the principles of this disclosure. In other examples, stock 115 may be removable. Stock 115 can also be made of a variety of materials, including but not limited to those materials used to make frame 102.

In some examples, crossbow 100 does not include a stock 115 and can be fired like a pistol. In other examples, frame 102 has a multiple-piece construction. Frame 102 may include a variety of mounting points (which can be part on one or more rails etc.) for various modular accessories such as a quiver, a scope, a flashlight, or other attachments.

In the embodiment shown, a riser 107 is attached to frame 102. Riser 107 provides additional mounting locations for components, including flexible limbs 112, 116 and string stops 176, 178. In certain embodiments, riser 107 and frame 102 may be formed as a singular component without departing from the principles of this disclosure. Riser 107 is made of a glass/carbon fiber composite but may alternatively be made of aluminum or other suitable materials.

Frame 102 further includes a projectile axis A for supporting and guiding a projectile. In some examples, a projectile rest may be included that is positioned along projectile axis A to provide additional support for the projectile. In some examples, the projectile rest can include bristles or arms to cradle the projectile.

The crossbow 100 can include a plurality of accessory rails 124. In some examples, the accessory rail 124 can be a picatinny rail. In some examples, the accessory rail 124 is configured to receive a sighting apparatus, such as a scope 190. In some examples, one of the accessory rails 124 is configured to receive a lighting device, such as a flashlight. In some examples, one of the accessory rails 124 is configured to receive a quiver.

The grip 128 provides a point of support for a user of the crossbow 100. The grip 128 can be held by the user's hand, including when operating the trigger assembly 122. The grip 128 assists the user in stabilizing the crossbow 100 during firing and handling. In some embodiments, the grip 128 is mounted to the frame 102. In some embodiments, the crossbow 100 has a plurality of grips 128 mounted to the frame 102.

Crossbow 100 includes a frame 102, a riser 107, a first power cable 104, and a first flexible limb 112. Crossbow 100 further includes a second power cable 106, and a second flexible limb 116. In certain embodiments, crossbow 100 may include additional or fewer power cables without departing from the principles of this disclosure. Crossbow 100 also includes a first cam 119 and a second cam 121. A drawstring 108 is connected to and extends between the cams 119, 121. In some embodiments, additional or fewer cams may be included without departing from the principles of this disclosure.

The Projectile moves within a horizontal projectile plane and travels along a projectile axis A when crossbow 100 is fired. Crossbow 100 fires the projectile from a front end 103 of the crossbow. In certain examples, crossbow 100 is generally symmetrical about the projectile axis A.

In certain embodiments, the power cables 104, 106 are coupled to the flexible limbs 112, 116 and the cams 119, 121. The flexible limbs 112, 116 are the source of power for crossbow 100. However, the power source can be provided by any suitable source including but not limited to—spring(s) and/or motor(s). In certain embodiments, the power cables 104, 106 are replaceable, such as when they are worn, for example. In some examples, the crossbow 100 is provided without power cables 104, 106, and the power cables 104, 106 can be subsequently added by a user or technician. The power cables 104, 106 can be constructed of traditional bowstring material such as, but not limited to, composite and/or natural fibers.

Figure 9:
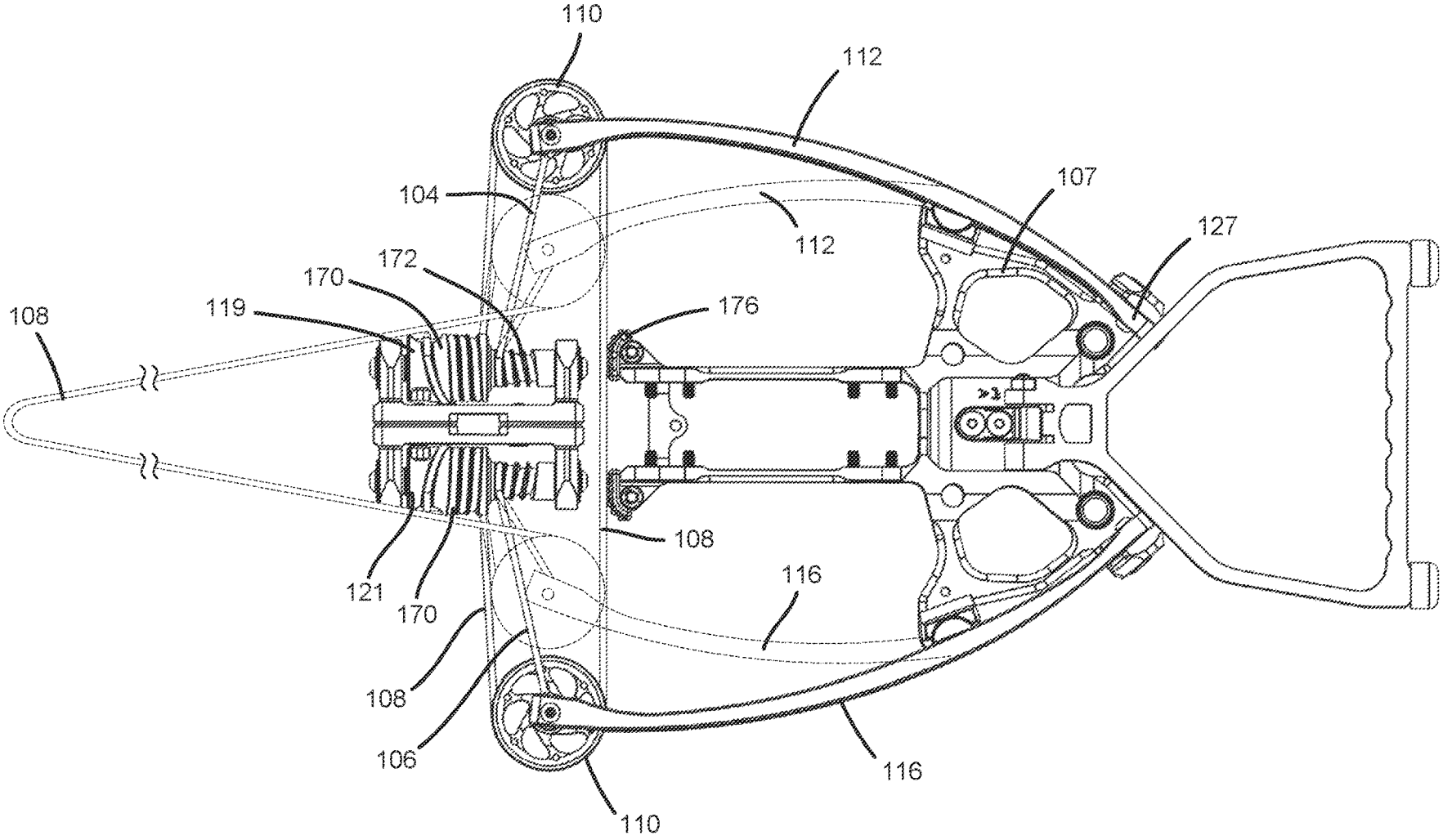
FIG. 9 is top view of the riser, flexible limbs, and cam and pulley system for the crossbow of FIG. 1, shown in the undrawn position and also showing the drawn position of the flexible limbs.
Figure 10:
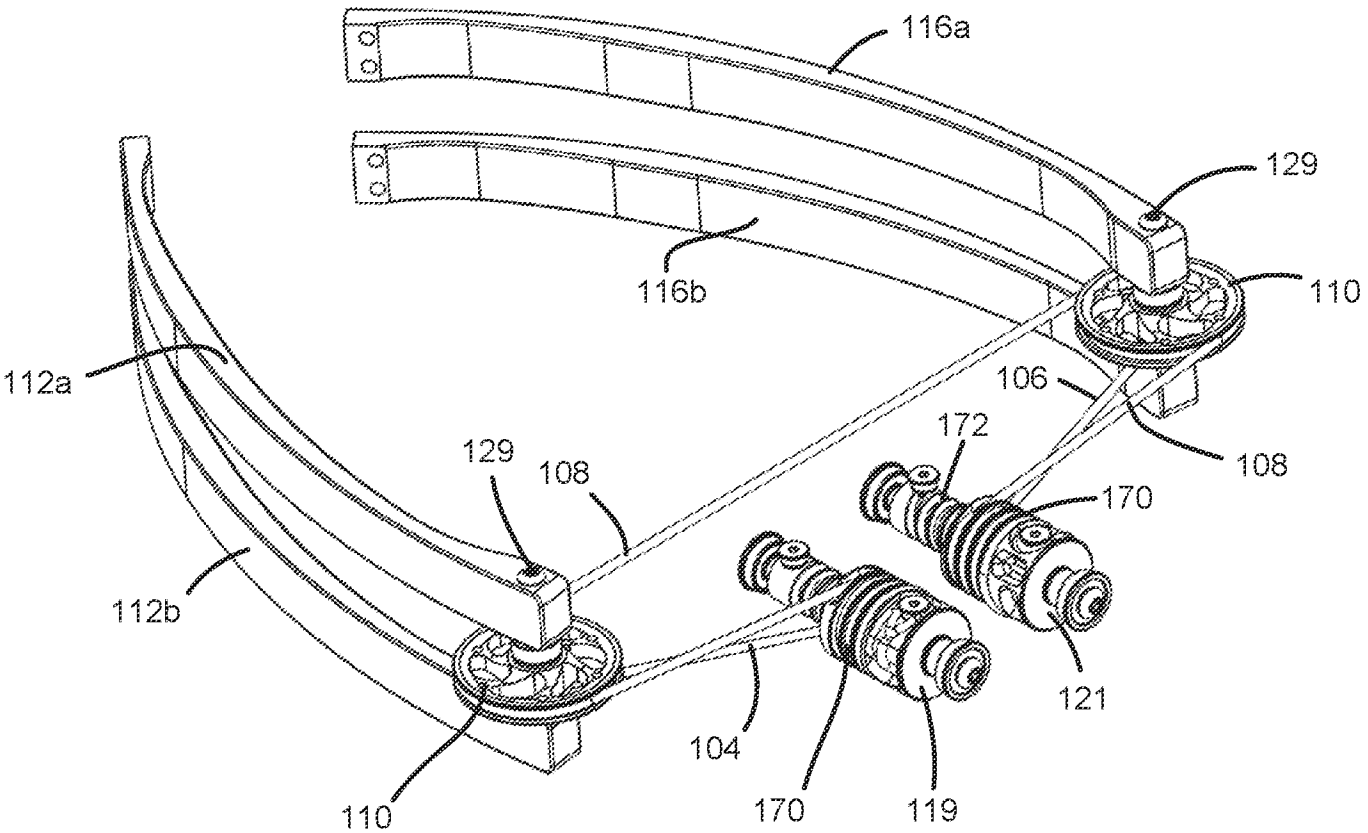
FIG. 10 is a rear perspective view of the flexible limbs and cam and pulley system for the crossbow of FIG. 1, shown in the undrawn position.
Figure 11:
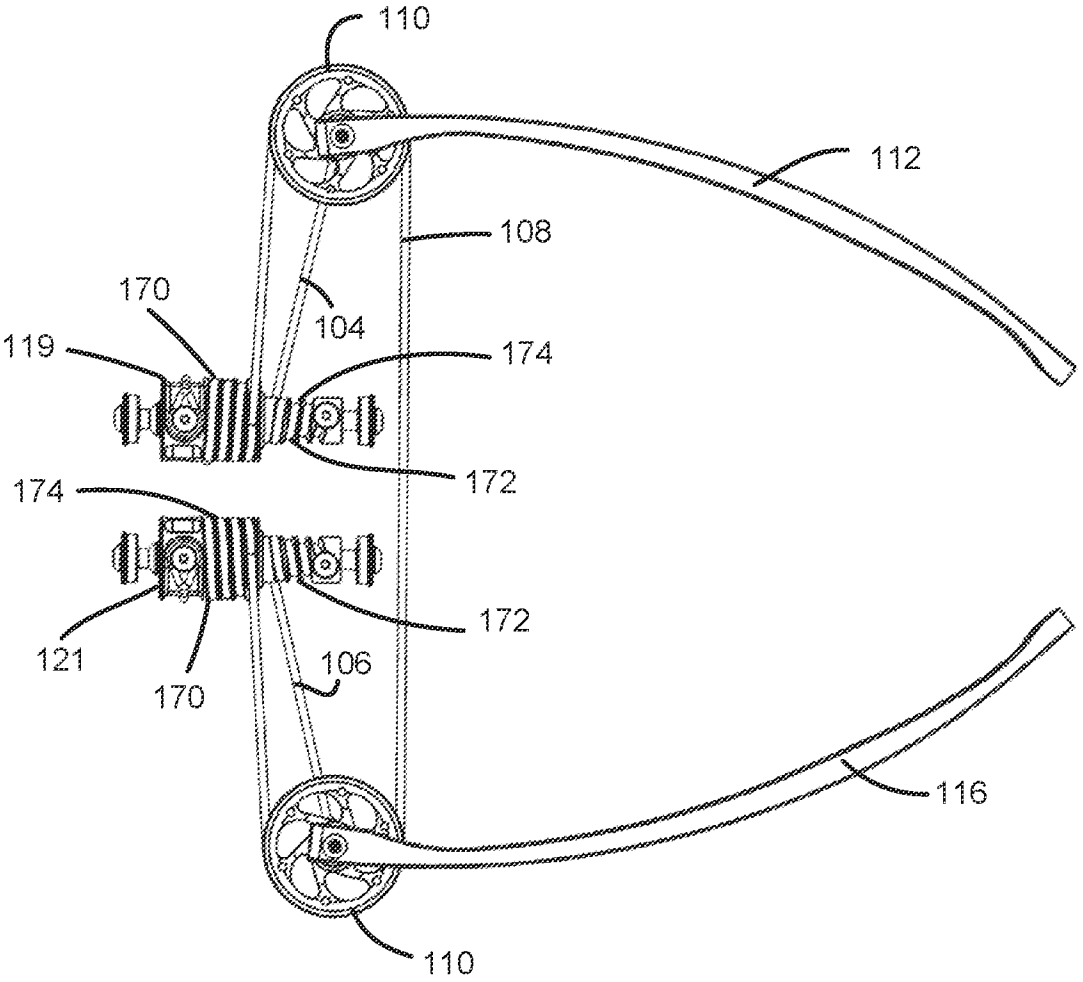
FIG. 11 is a top view of the flexible limbs and cam and pulley system for the crossbow of FIG. 1, shown in the undrawn position.
Figure 12:
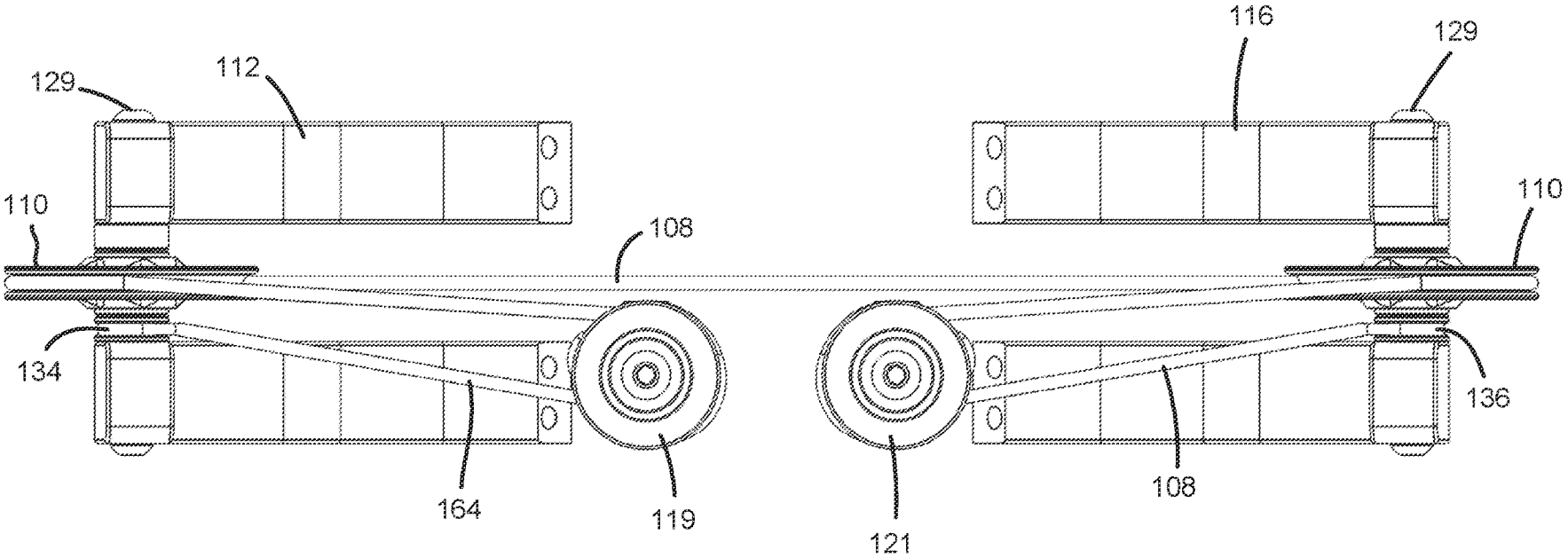
FIG. 12 is a rear view of the flexible limbs and cam and pulley system for the crossbow of FIG. 1, shown in the undrawn position.
Figure 13:
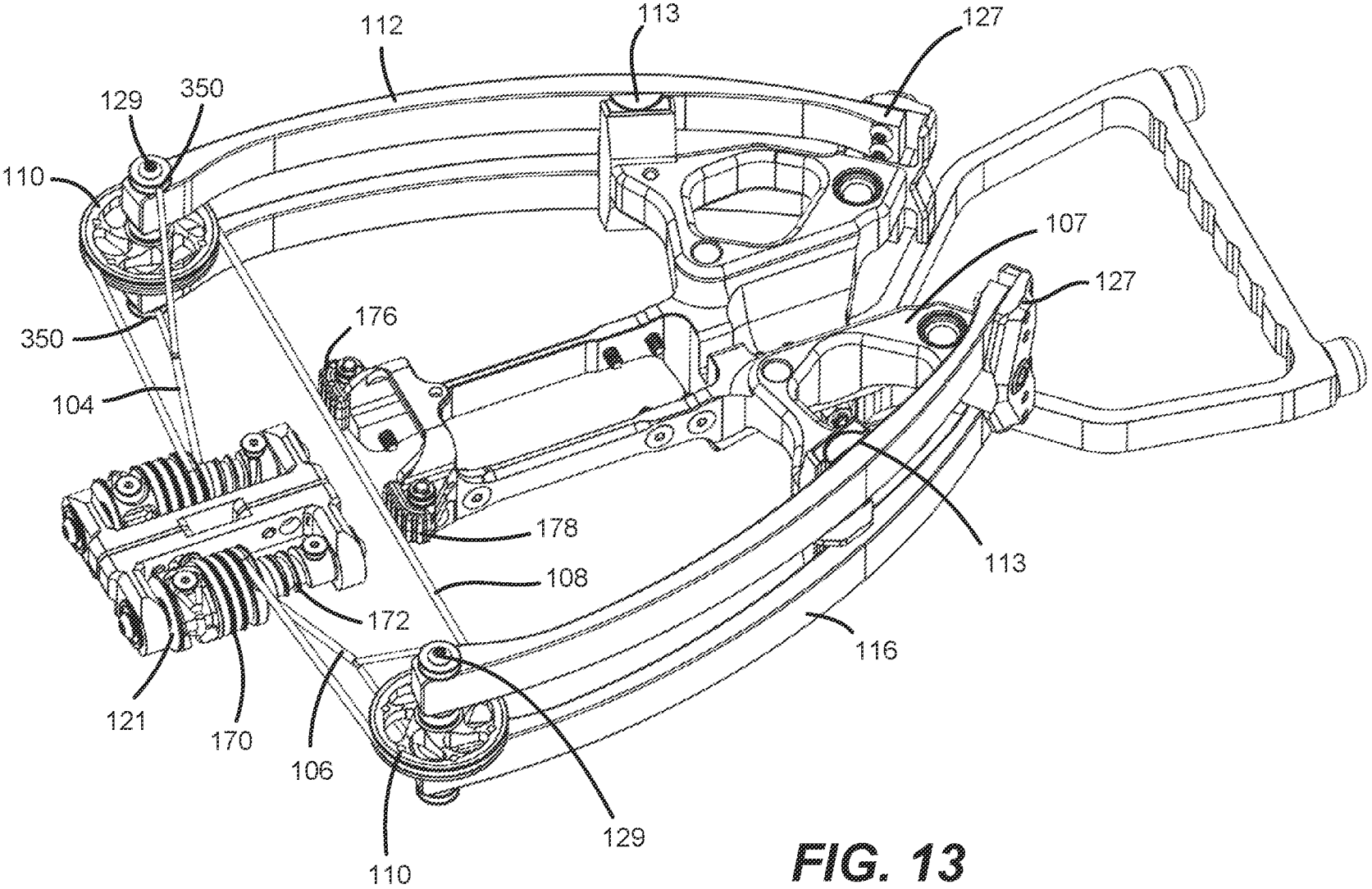
FIG. 13 is a rear perspective view of one embodiment of a riser, flexible limbs, and cam and pulley system for the crossbow of FIG. 1, shown in the undrawn position.
Figure 14:
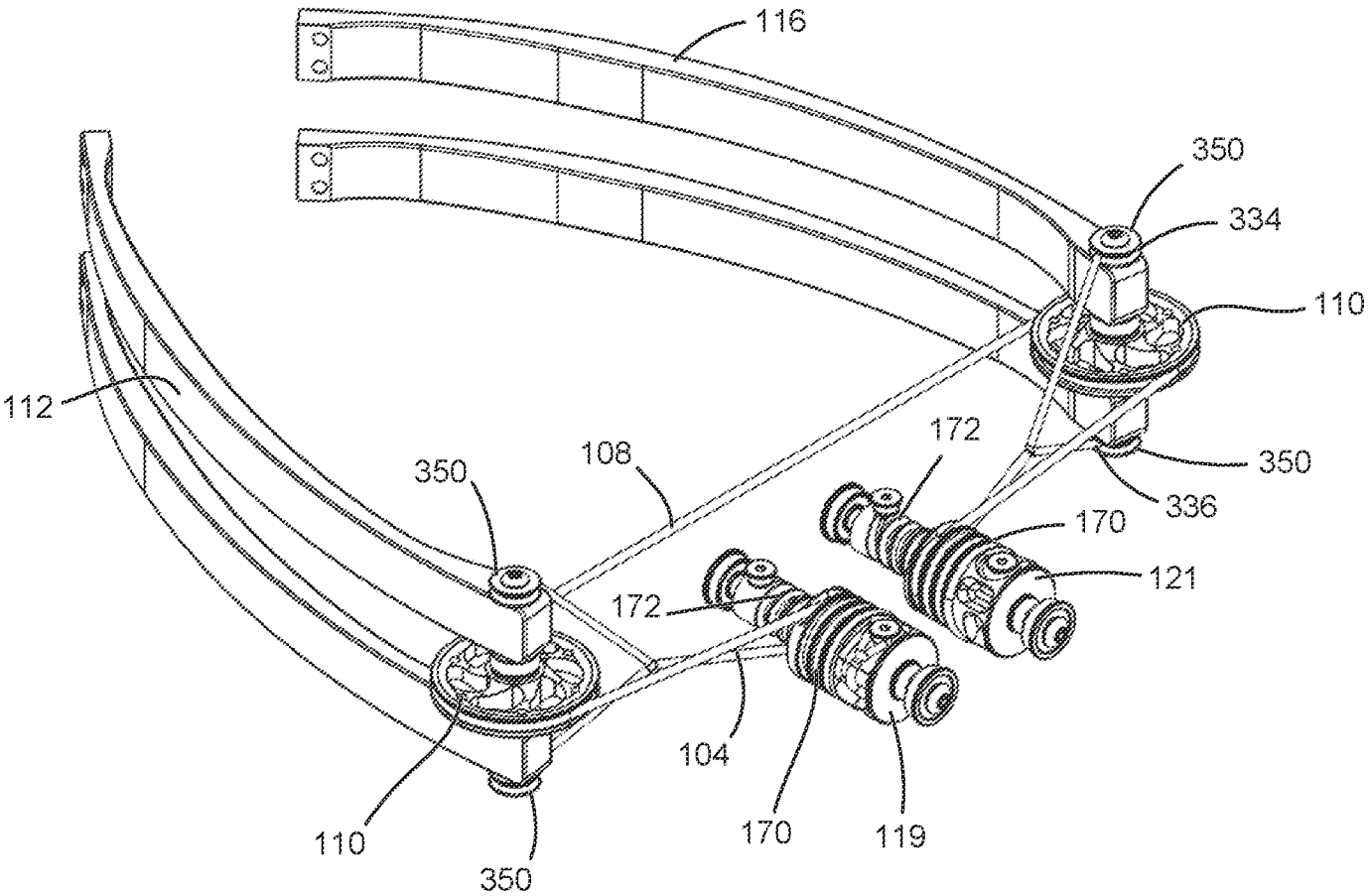
FIG. 14 is a rear perspective view of the flexible limbs and cam and pulley system of FIG. 13, shown in the undrawn position.
Figure 15:
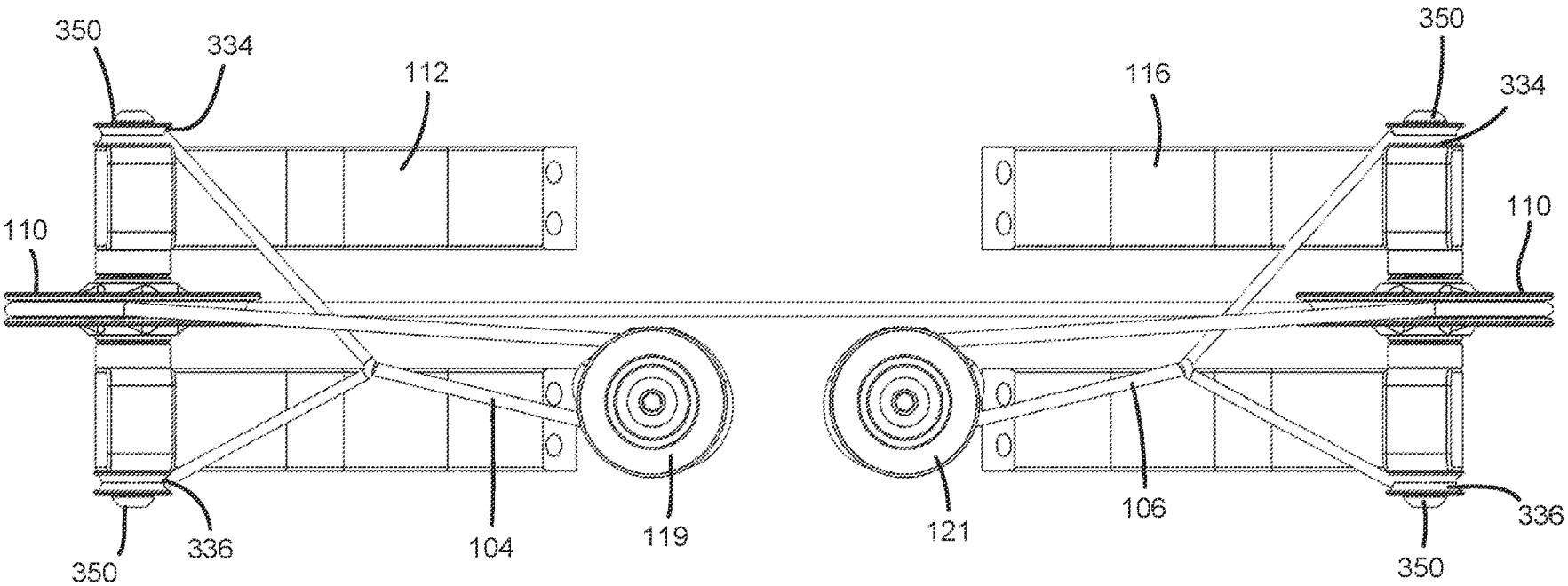
FIG. 15 is a rear view of the flexible limbs and cam and pulley system of FIG. 13, shown in the undrawn position.

FIG. 9 is a top view of the riser 107, flexible limbs 112, 116, and cams 119, 121 of crossbow 100 shown in the undrawn position and also showing the drawn position of the flexible limbs. As shown, crossbow 100 can fire a projectile, such as an arrow. One example of an arrow is a bolt. In certain embodiments, the projectile is an arrow with a pointed tip and fletching to help stabilize the projectile as it moves through the air when the projectile is fired from the crossbow 100.

As shown, when the crossbow 100 is drawn, the power cables 104, 106 cause the flexible limbs 112, 116 to bend toward the projectile axis A, thereby loading the limbs.

Each flexible limb 112, 116 is attached to riser 107 at a first end 127. Second ends 134, 136 of power cables 104, 106 are attached to second ends 129 of the flexible limbs 112, 116. Limb pivots 113 are positioned between the first ends 127 and second ends 129 of the flexible limbs 112, 116. In the embodiment shown, limbs 112, 116 are elastic and spring-like in nature. As shown, limbs 112, 116 are made of a glass/carbon fiber composite, but any other suitable material may be used without departing from the principles of this disclosure.

Limbs 112, 116 extend in an outward direction from the projectile axis A and in a rearward direction toward the rear end 105 of the crossbow 100. The limbs 112, 116 are positioned at either side of the projectile axis A such that the projectile passes between the limbs 112, 116 when the crossbow 100 is fired.

In some examples, the limbs 112, 116 extend in an outward direction from the projectile axis A and/or in a forward direction toward the front end 103 of the crossbow 100. In some examples, the limbs 112, 116 extend in an upward direction from projectile axis A and/or in a forward direction toward the front end 103 of the crossbow 100. In some examples, the limbs 112, 116 extend in an upward direction from projectile axis A and/or in a rearward direction toward the rear end 105 of the crossbow 100. Limbs 112, 116 may be positioned in a variety of different ways relative to the projectile axis A without departing from the principles of this disclosure.

Crossbow 100 has three separate cables—two identical power cables 104, 106 and a drawstring 108—coupled together by cams 119, 121. Cams 119, 121 are rotatably attached to frame 102 and positioned on opposite sides of projectile axis A Cams 119, 121 each include an axis of rotation that is substantially parallel to projectile axis A. In certain alternative embodiments, the axis of rotation of cams 119, 121 may be positioned at an angle between zero degrees (0°) and ninety degrees (90°) in either the vertical or horizontal direction with respect to projectile axis A without departing from the principles of this disclosure. In certain embodiments, cams 119, 121 may also be positioned above or below the projectile axis A relative to the frame. As shown, cams 119, 121 are positioned below projectile axis A Orienting the cams 119, 121 so that the cam axis of rotation is substantially parallel to projectile axis A allows the cams to be positioned closer to the frame than would be possible if the cam axis of rotation were perpendicular to the projectile axis.

As shown, each cam 119, 121 includes a larger diameter portion 170 and a smaller diameter portion 172. One larger diameter portion 170 and one smaller diameter portion 172 are coaxial and—in the embodiment shown—are integrally formed as one cam 119, 121. Both of the smaller diameter portions 172 and larger diameter portions 170 include helical grooves 174 that guide the power cables 104, 106 and drawstring 108 as they selectively wind around the cam 119, 121. By decreasing the diameter of the larger diameter portion 170 and smaller diameter portion 172 of cams 119, 121 while maintaining the necessary arc lengths for helical grooves 174, the overall mass moment of inertia representing each cam, 119 and 121, can be reduced and the angular acceleration is thereby increased. This effect can lead to improvements in dynamic efficiencies and increased performance attributes as compared to more conventional cam sizes and arrangements.

Smaller diameter portions 172 provide anchor locations to power cables 104, 106 and drawstring 108 is connected to and extends between the larger diameter portions 170. In certain embodiments, power cable 104, 106 and drawstring 108 selectively wind around cams 119, 121 a plurality of complete rotations. In the embodiment shown, the diameters of power cables 104, 106 and drawstring 108 are the same, so the helical grooves 174 are the same size, whether they are on the larger diameter portion 170 or smaller diameter portion 172. In certain embodiments, however, the cables 104, 106 and drawstring 108 may differ in diameter. As such, helical grooves 174 may vary in size to accommodate cables of different diameters.

Each cam 119, 121 relies on the principle of wheel and axle mechanical advantage. The smaller diameter portion 172 and the larger diameter portion 170 rotate at the same rate and complete one full rotation in the same period of time. However, due to the size difference in the radius of the wheel and axle-larger diameter portion 170 and smaller diameter portion 172, respectively—the distance the two parts rotate through is different. The basic equation for wheel and axle ideal mechanical advantage is $$IMA = \frac{R}{r},$$

with R=radius of the larger diameter portion 170 and r=radius of the smaller diameter portion 172. Of course, in the real world some of the advantage is lost due to the friction of the system, but it is sufficient to illustrate the wheel-axle principle as shown in FIG. 23. The mechanical advantage of the cam 119, 121 can be selected by choosing the radii R and r, and may vary as desired.

In certain embodiments, limb pulleys 110—which freely rotate—are positioned near the ends of flexible limbs 112, 116 and can freely rotate to guide the drawstring 108 as it extends from the larger diameter portions 170 on cams 119, 121 and across projectile axis A. In certain embodiments, string stops 176, 178 are positioned on either side of projectile axis A limit how far the drawstring can travel toward the front 103 of crossbow 100 when a projectile is fired. In the embodiment shown, string stops 176, 178 are mounted to riser 107, but may alternatively be mounted to the frame 102. In certain embodiments string stops 176, 178 may be integrally formed in either the riser 107 or the frame 102. The power cables 104, 106 are attached at first ends to the flexible limbs 112, 116 and at second ends are attached to the smaller diameter portion 172 of the cams 119, 121.

Figure 8:
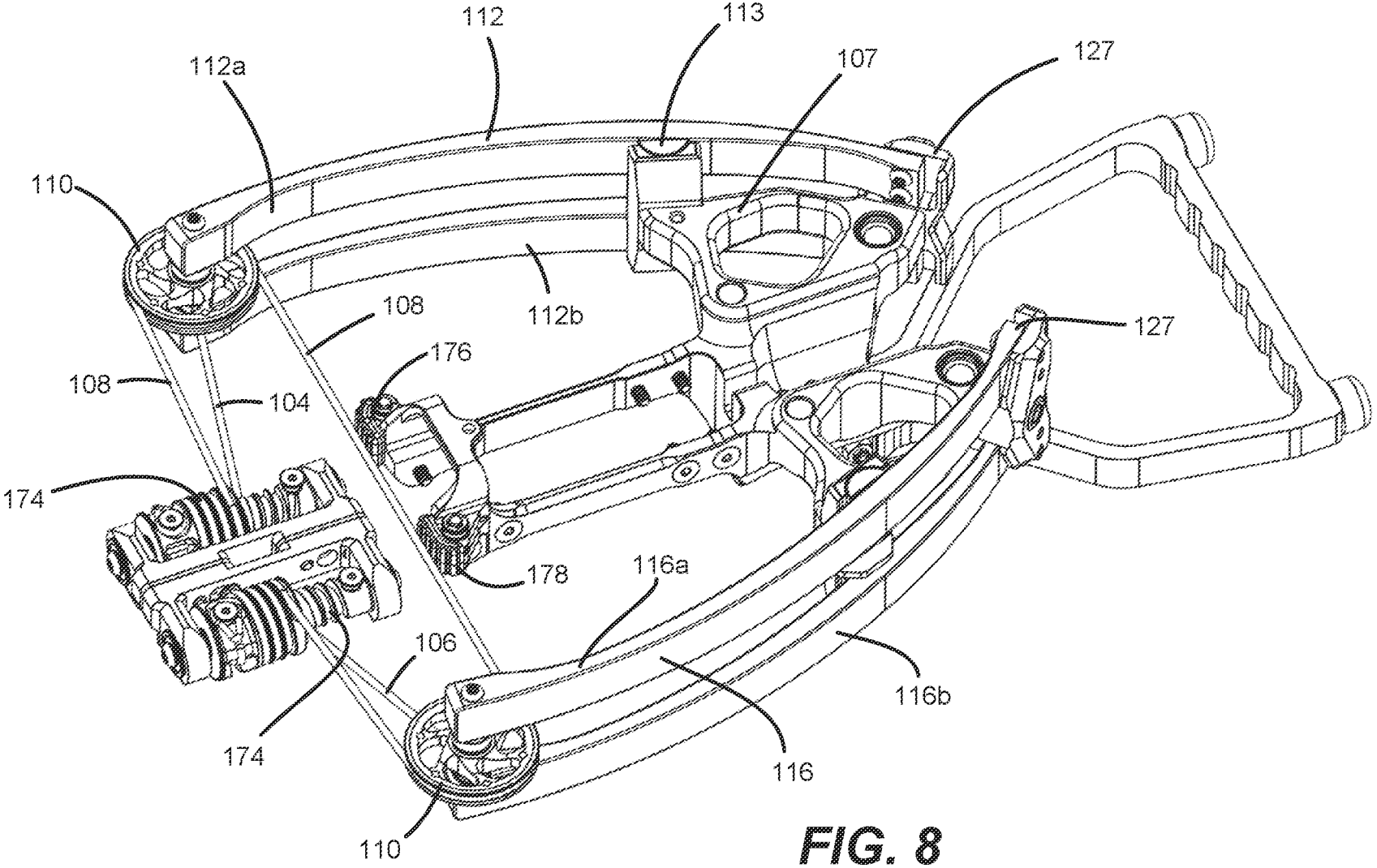
FIG. 8 is a rear perspective view of a riser, flexible limbs, and cam and pulley system for the crossbow of FIG. 1, shown in the undrawn position.

FIG. 8 shows a top detail view of a portion of the crossbow 100 including the riser but with the frame 102 removed and the power cables 104, 106 and drawstring 108 undrawn. FIG. 9 shows a top view of the same portion of crossbow 100, with power cables 104, 106 and drawstring 108 drawn. As shown, the first and second limbs 112, 116 each include separate members 112*a*/112*b*, 116*a*/116*b*. The separate members of each of the first and second limbs 112, 116 are configured to flex together by way of the power cable 104. It is considered within the scope of the present disclosure that the first and second limbs 112, 116 can include any number of separate members.

In certain embodiments, when crossbow 100 is drawn—with drawstring 108 cocked and ready to fire—power cables 104, 106 are wound around smaller diameter portions 172. In certain embodiments, the power cables 104, 106 are wound around smaller diameter portions 172 a plurality of complete rotations. As drawstring 108 is drawn, the cable unwinds from larger diameter portions 170 of cams 119, 121. The unwinding of larger diameter portions 170 causes cams 119, 121 to rotate, thereby causing power cables 104, 106 to wind around smaller diameter portions 172.

As shown in FIG. 9, when crossbow 100 is undrawn—with drawstring 108 uncocked-power cables 104, 106 are attached to the smaller diameter portions 172 but are not wound around the smaller diameter portions significantly. In certain embodiments, power cables 104, 106 may be wound around the smaller diameter portions 172 any suitable amount without departing from the principles of this disclosure. Meanwhile, when the crossbow 100 is undrawn, drawstring 108 is attached to larger diameter portions 170 and wound around them—in certain embodiments—a plurality of complete rotations. Drawstring 108 may be wound around larger diameter portions 170 any suitable number of times without departing from the principles of this disclosure.

The mechanical advantage between larger diameter portions 170 and smaller diameter portions 172 reduces the draw weight necessary to draw the drawstring 108 to the cocked position. To draw crossbow 100, it is stabilized and drawstring 108 is pulled to the rear end 105 of the crossbow 100. A cocking system may used to draw the drawstring 108 from an uncocked position to a cocked position. One example of a cocking system in accordance with the present disclosure is described in U.S. Pat. No. 10,077,965, the entirety of which is incorporated herein by reference for all purposes. In certain alternative embodiments, an arming device, the user's arm, or other like mechanism can be used to draw the drawstring 108.

Two alternative embodiments of power cables 104, 106 are shown in FIGS. 13-15 and 16-18, respectively. In the embodiment shown in FIGS. 13-15, second ends 334, 336 of power cables 104, 106 are split such that there are two attachment points 350 at second ends 129 of the flexible limbs 112, 116. Splitting the second ends 334, 336 more evenly distributes the force applied to the flexible limbs 112, 116 by the power cables 104, 106.

Figure 16:
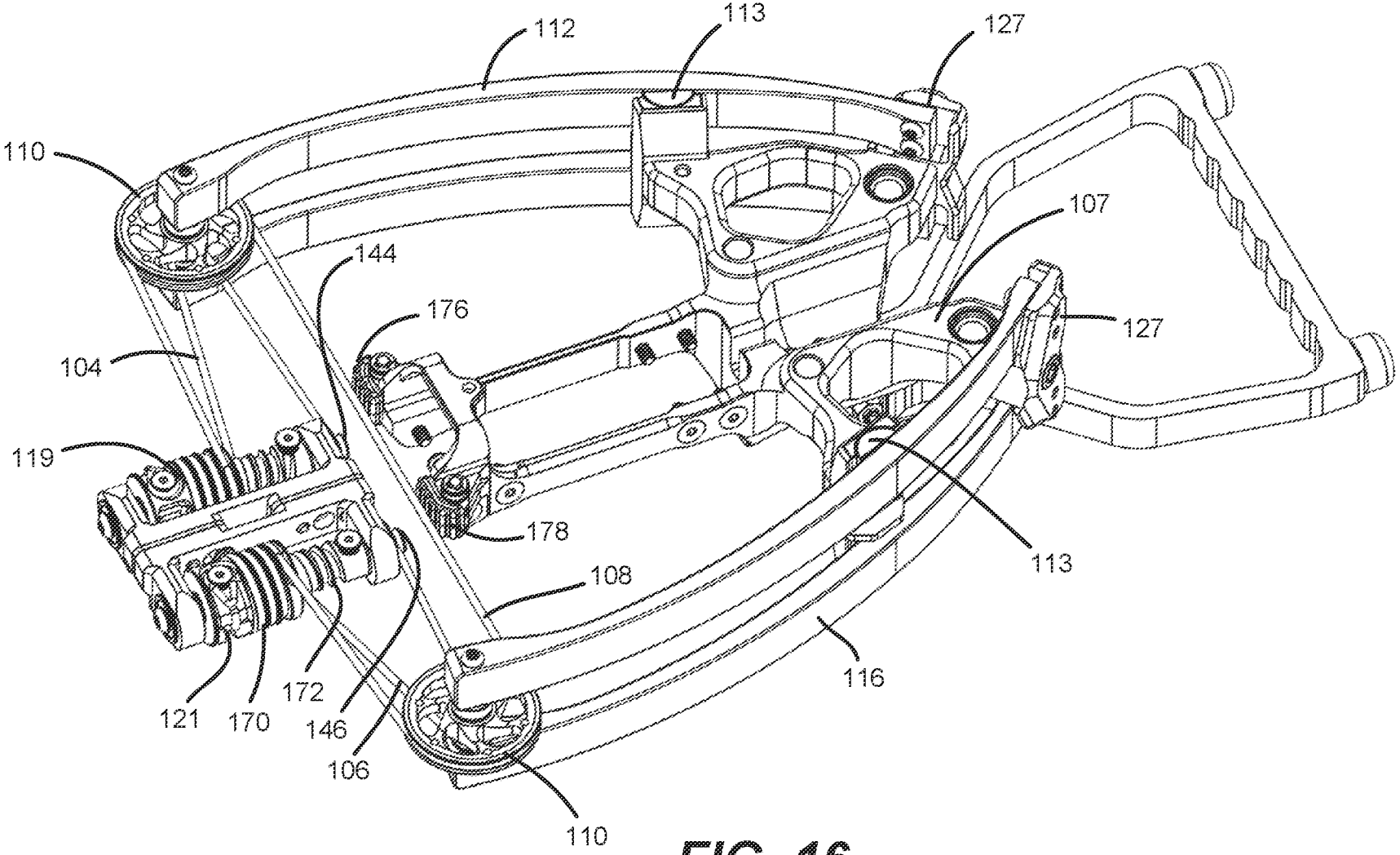
FIG. 16 is a rear perspective view of one embodiment of a riser, flexible limbs, and cam and pulley system for the crossbow of FIG. 1, according to the principles of the present disclosure, showing the crossbow in an undrawn position.
Figure 17:
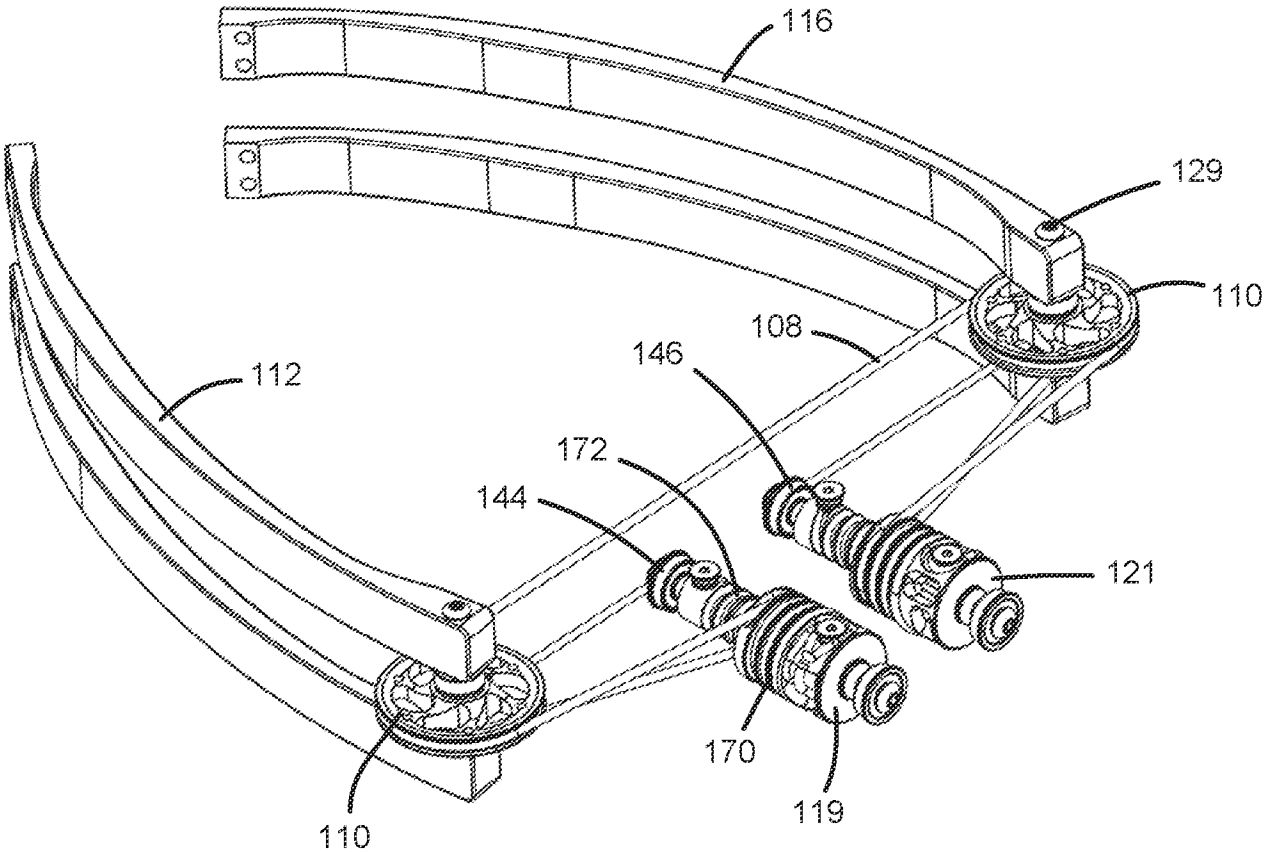
FIG. 17 is a rear perspective view of the flexible limbs and cam and pulley system of FIG. 16, shown in the undrawn position.
Figure 18:
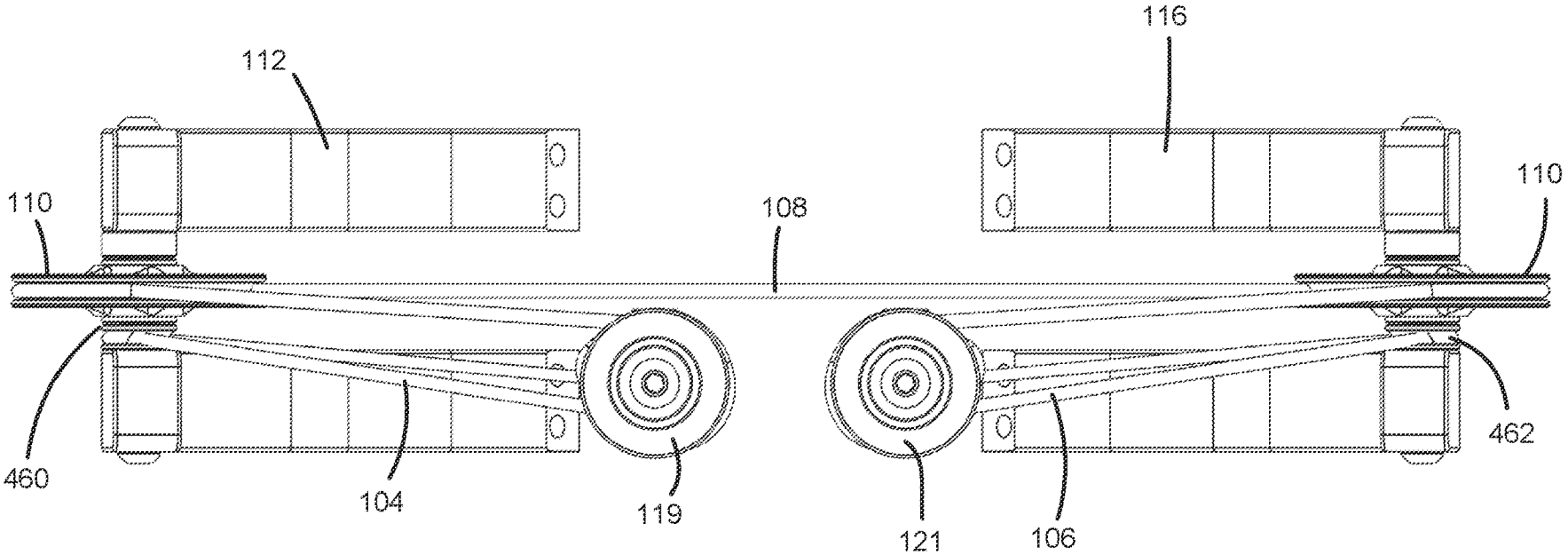
FIG. 18 a rear view of the flexible limbs and cam and pulley system of FIG. 16, shown in the undrawn position.
Figure 19:
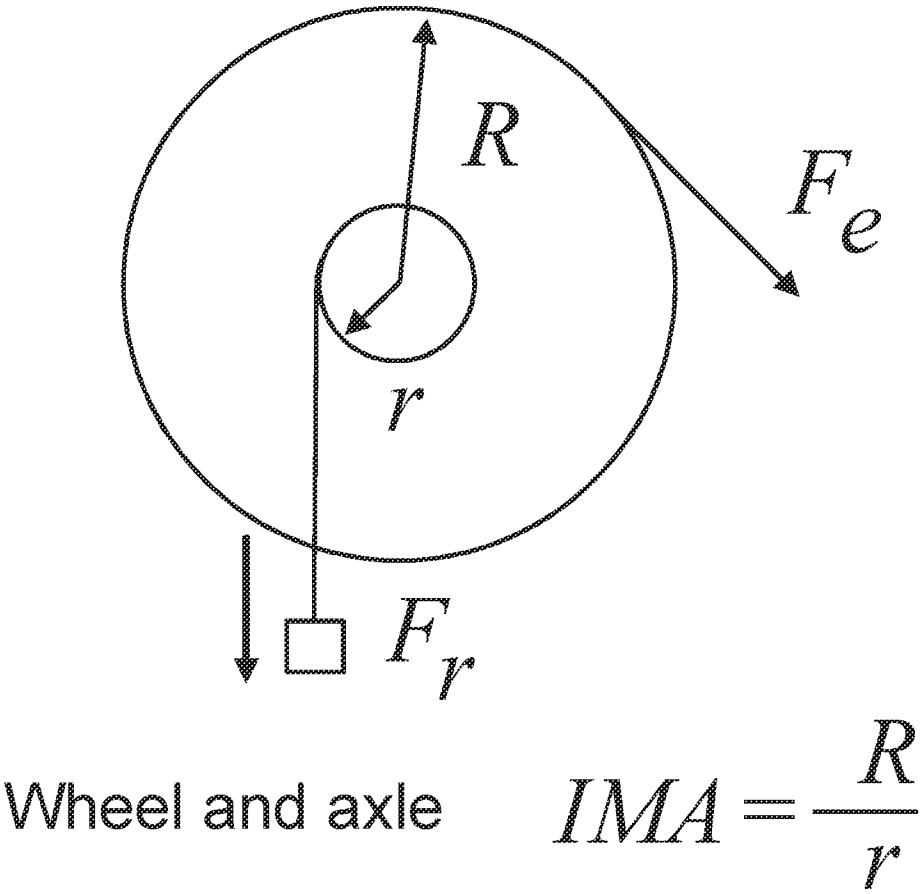
FIG. 19 is a diagram illustrating the principle of wheel-axle mechanical advantage.

In the embodiment shown in FIGS. 16-18, first ends 140, 142 of power cables 104, 106 are attached to opposite sides of frame 102 at mounting locations 144, 146. Power cables 104, 106 are routed around power cable pulleys 460, 462—which are positioned at the second ends 129 of the flexible limbs 112, 116—and back to smaller diameter portions 172 of cams 119, 121. Routing power cables 104, 106 around the power cable pulleys 460, 462 reduces the force needed to draw the drawstring 108 to cock the crossbow 100.

In certain embodiments, crossbow 100 includes a cocking system that includes a drawstring holder 180. In certain embodiments, the drawstring holder 180 slides along frame 102 toward the riser 107 to engage the drawstring 108 while it is in the undrawn position. That is, the drawstring holder 180 is slidably attached to frame 102 and moves in a single degree of freedom along the projectile axis A. The engagement of drawstring holder 180 with the frame 102 substantially prevents the cable carrier from moving in any other direction relative to projectile axis A and the riser 107.

After drawstring holder 180 has captured the drawstring 108 and is engaged with trigger assembly 122, it is almost ready to fire. Next, a user loads a projectile onto crossbow 100 along the projectile axis A and engages with the drawstring 108, which is still captured by the drawstring holder 180.

Once the projectile is engaged with drawstring holder 180, it is ready to fire. A user may actuate trigger assembly 122 to fire the crossbow 100. The trigger assembly 122 is in communication with the drawstring holder 180 so that upon activation of the trigger assembly 122 when firing (e.g., pulling the trigger toward the rear end 105 of the crossbow 100), the trigger assembly 122 moves portions the drawstring holder 180 and the drawstring 108 is released and free to travel toward the front end 103 of the crossbow 100. In some examples, the trigger assembly 122 includes a safety and/or anti-dry fire protection. As the drawstring 108 travels toward the front end 103 it carries the projectile with it until the projectile is fired from the front end 103 of crossbow 100.

FIGS. 8-12 show the arrangement of the cables 104, 106, drawstring 108, limb pulleys 110, and cams 119, 121 in greater detail. The limb pulleys 110 and cams 119, 121 may include grooves sized and shaped to receive a power cable 104, 106 or drawstring 108. The limb pulleys 110 and cams 119, 121 are made from a material to minimize any slippage between the power cables 104, 106 and drawstring 108 and the pulleys and cams. Any suitable material may be used without departing form the scope of the present disclosure. For example, the groove can be textured, e.g., lined with a high grip material or mechanical feature to grab the power cables 104, 106 and drawstring 108. In certain embodiments, the limb pulleys 110 may be constructed of low friction material. In such an example, the limb pulleys 110 can be fixed rather than freely rotating. As shown, limb pulleys 110 are shown as circular, but the pulleys can also have other shapes, such as lobe-shaped.

Although the embodiments herein described are what are perceived to be the most practical and preferred embodiments, this disclosure is not intended to be limited to the specific embodiments set forth above. Rather, modifications may be made by one of skill in the art of this disclosure without departing from the spirit or intent of the disclosure.

What is claimed is:

1. A crossbow, comprising:

a frame including a first frame side and a second frame side, the frame defining a projectile axis;

a first flexible limb coupled to the first frame side and a second flexible limb coupled to the second frame side;

a first cam coupled to the first frame side and configured to rotate about a first cam axis that is substantially parallel to the projectile axis;

a second cam coupled to the second frame side and configured to rotate about a second cam axis that is substantially parallel to the projectile axis, a drawstring engaged with the first cam and the second cam; and a first power cable engaged with the first cam and the first flexible limb; and a second power cable engaged with the second cam and the second flexible limb.

2. The crossbow of claim 1, wherein the first cam includes a smaller diameter portion and a larger diameter portion that respectively include a groove configured to receive one of the first power cable and the drawstring.

3. The crossbow of claim 2, wherein the larger diameter portion and smaller diameter portions of the first cam and the second cam are coaxial.

4. The crossbow of claim 2, wherein the first power cable is engaged with the smaller diameter portion of the first cam and the drawstring is engaged with the larger diameter portion of the first cam.

5. The crossbow of claim 1, wherein, during operation of the crossbow as the crossbow moves from an undrawn position to a drawn position, the drawstring is configured to wrap around at least a portion of the first cam and the second cam.

6. The crossbow of claim 1, wherein, during operation of the crossbow as the crossbow moves from an undrawn position to a drawn position, the first power cable is configured to wrap around at least a portion of the first cam and the second power cable is configured to wrap around at least a portion of the second cam.

7. The crossbow of claim 1, further including:

a drawstring holder; and a trigger assembly configured to release the drawstring from the drawstring holder when the trigger assembly is activated.

8. The crossbow of claim 1, wherein, during operation of the crossbow as the crossbow moves from an undrawn position to a drawn position, the drawstring is configured to wind around the first cam at least one full rotation.

9. A crossbow, comprising:

a frame including a frame side and defining a projectile axis;

a flexible limb coupled to the frame side;

a drawstring coupled to the flexible limb and configured to move within a first plane, wherein the projectile axis extends within the first plane;

a power cable engaged to the flexible limb;

a cam coupled to the frame side and configured to rotate about a cam axis that extends within a second plane, the second plane substantially parallel to the first plane, the cam including:

a first portion configured to engage the drawstring; and a second portion configured to engage the power cable.

10. The crossbow of claim 9, further comprising:

a limb pulley coupled to the flexible limb and configured to engage the drawstring.

11. The crossbow of claim 9, further comprising a projectile rest positioned at a front end of the frame.

12. The crossbow of claim 9, further comprising a drawstring holder configured to selectively receive and retain the drawstring at a rear end of the frame.

13. The crossbow of claim 9, wherein the first portion and the second portion of the cam are coaxial.

14. The crossbow of claim 9, wherein the first portion includes a first diameter that is larger than a second diameter of the second portion, the first portion and the second portion including each including a groove configured to receive respectively receive a portion of the drawstring and the power cable.

15. The crossbow of claim 9, wherein the second plane is vertically below the first plane.

16. The crossbow in claim 9, further comprising:

a power cable pulley coupled to the flexible limb and configured to engage the power cable.

17. A crossbow, comprising:

a frame defining a projectile axis;

a first flexible limb and a second flexible limb coupled with the frame;

a first cam coupled with the frame and configured to rotate about a first axis positioned vertically below the projectile axis, the first cam including a first portion and a second portion;

a second cam coupled with the frame and configured to rotate about a second axis positioned vertically below the projectile axis, the second cam including a first portion and a second portion;

a drawstring engaged with the first portion of the first cam and the first portion of the second cam;

a first power cable engaged with the first flexible limb and the second portion of the first cam; and a second power cable engaged with the second flexible limb and the second portion of the second cam.

18. The crossbow of claim 17, further comprising:

a first pulley coupled with the first flexible limb; and a second pulley coupled with the second flexible limb;

wherein the drawstring is routed from the first portion of the first cam to the first pulley, from the first pulley to the second pulley, and from the second pulley to the first portion of the second cam.

19. The crossbow of claim 17, further comprising:

a first power cable pulley coupled with the first flexible limb; and the first power cable including a first end coupled with the frame and a second end coupled with the second portion of the first cam;

wherein the first power cable is routed from the frame to the first power cable pulley and from the first power cable pulley to the second portion of the first cam.

20. The crossbow of claim 17, wherein the first axis is substantially parallel to the projectile axis.

* * * * *